US005348166A

United States Patent [19]

Lema

[11] Patent Number: 5,348,166

[45] Date of Patent: Sep. 20, 1994

[54] BALL CAP STORAGE RACK

[76] Inventor: Greg Lema, 4022 Glendale Ct., Merced, Calif. 95348

[21] Appl. No.: 51,623

[22] Filed: Apr. 22, 1993

[51] Int. Cl.[5] ..... A47F 7/00

[52] U.S. Cl. ..... 211/30; 211/113; 211/119

[58] Field of Search ..... 211/30, 31, 32, 87, 211/106, 113, 119; 248/309.1, 317, 339, 340

[56] References Cited

U.S. PATENT DOCUMENTS

| | | | |
|---|---|---|---|
| 2,633,994 | 4/1953 | Brown | 211/106 X |
| 3,737,081 | 6/1973 | James | 211/30 X |
| 4,421,238 | 12/1983 | Patton | 211/106 X |
| 4,805,782 | 2/1989 | Hale et al. | 211/30 |
| 4,993,557 | 2/1991 | Davis | 211/30 |
| 5,086,931 | 2/1992 | Cobb | 211/88 X |
| 5,209,359 | 5/1993 | Arnold | 211/106 |

*Primary Examiner*—Robert W. Gibson, Jr.
*Attorney, Agent, or Firm*—Claude A. S. Hamrick

[57] ABSTRACT

Ball cap storage rack comprising a wire or rod stock frame including a plurality of rods configured to form an elongated, generally rectangular-shaped back with side capture bars and a pair of hooks at one end. The back has a width slightly narrower than the width of a typical baseball cap visor and is adapted to have its length running vertically when in normal use. Two additional sets of rods are arrayed along opposite sides of the back to form side capture rails, and define visor edge receiving openings. The upper ends of the rails are deformed to provide a closet pole hanger at the upper end of the rack, and the lower ends are deformed to form the capture fingers at a lower portion of the device. To store a plurality of baseball caps in the rack, the caps are placed with their visors flat against the back with the soft cap portion collapsed forwardly and the bill of each successive cap slipped behind the preceding one and the folded cap nested against the same part of the preceding cap. The visor edges protrude through openings in the rack sides. The caps are restrained in the rack by capture fingers at the lower ends of the side rails.

10 Claims, 3 Drawing Sheets

BALL CAP STORAGE RACK

BACKGROUND OF THE INVENTION

1. Field of the Invention

The present invention relates to hat and cap storage devices, and more particularly to a cap storage rack for storing a plurality of baseball-type caps or the like, one upon the other with their visors extending vertically downward in parallel arrangement with each other and in a manner that provides access to an individual cap without requiring removal of the others, the device being configured for hanging on a closet pole or wall mounting.

2. Description of the Prior Art

Numerous methods and apparatus have been used in the past for storing hats, both individually and in groups. Storage of collections of caps or hats on various types of hooks is a common practice, and some such apparatus have been made the subject of patents. One such patent is entitled "STORAGE DEVICE" by Davis (U.S. Pat. No. 4,993,557) and addresses the problem of storing a plurality of baseball-type caps in a vertical stack arrangement. However, the number of caps storable in accordance with the Davis invention is limited by the length of vertical wooden rods supported in a base, and access to a particular cap requires removal of caps disposed above it. A problem not addressed by the prior art is how to conveniently store a large number of caps without the need for special mounting or support means.

SUMMARY OF THE PRESENT INVENTION

It is therefore an object of the present invention to provide a novel apparatus for compact storage of a large number of baseball-type caps.

Another object of the present invention is to provide a structure for facilitating the storage of caps without having to remove other caps to retrieve a particular cap.

A further object of the present invention is to provide a cap storage apparatus of the type described that can be conveniently suspended from a horizontal closet pole or be mounted on a wall.

Briefly, a presently preferred embodiment of the present invention is comprised of a wire or rod stock frame including a plurality of rods configured to form an elongated, generally rectangular-shaped back with side capture bars and a pair of hooks at one end. The back has a width slightly narrower than the width of a typical baseball cap visor and is adapted to have its length running vertically when in normal use. Two additional sets of rods are arrayed along opposite sides of the back to form side capture rails, and define visor edge receiving openings. The upper ends of the rails are deformed to provide a closet pole hanger at the upper end of the rack, and the lower ends are deformed to form the capture fingers at a lower portion of the device. To store a plurality of baseball caps in the rack, the caps are placed with their visors flat against the back with the soft cap portion collapsed forwardly and the bill of each successive cap slipped behind the preceding one and the folded cap nested against the same part of the preceding cap. The visor edges protrude through openings in the rack sides. The caps are restrained in the rack by capture fingers at the lower ends of the side rails.

The invention meets a particular need of those who collect numerous baseball caps and has the advantage of allowing a large number of such caps to be stored in a convenient and compact manner.

A further advantage of the present invention is that it does not require a special mounting and can be simply hung on a standard horizontal closet pole or wall hook.

A still further advantage of the present invention is the ease of access to any particular cap without the need to remove the other caps.

These and other objects and advantages of the present invention will no doubt become apparent to those skilled in the art after having read the following detailed description of the preferred embodiment which is illustrated in the several figures of the drawing.

IN THE DRAWING

DETAILED DESCRIPTION OF THE PREFERRED EMBODIMENT

Figure 1:
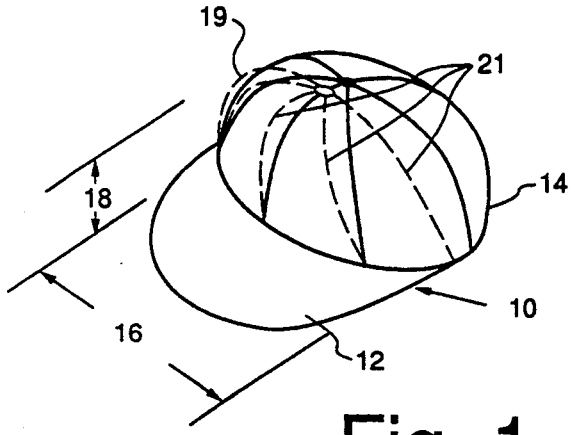
FIG. 1 is an illustration of a baseball cap in both usable and collapsed configuration.

Referring now to FIG. 1 of the drawing, a baseball cap is shown at 10 including a visor or bill 12 and flexible head-covering portion 14. The cap has a width determined by the width 16 of visor 12 and an effective height 18 determined by the height of the cap body 14 above the plane of the visor 12. To prepare a cap of the type illustrated for storage in accordance with the present invention, the rearmost portion of the cap body will be folded forward into the front portion thereof so as to assume the shape illustrated by the dashed lines 21.

Figure 2:
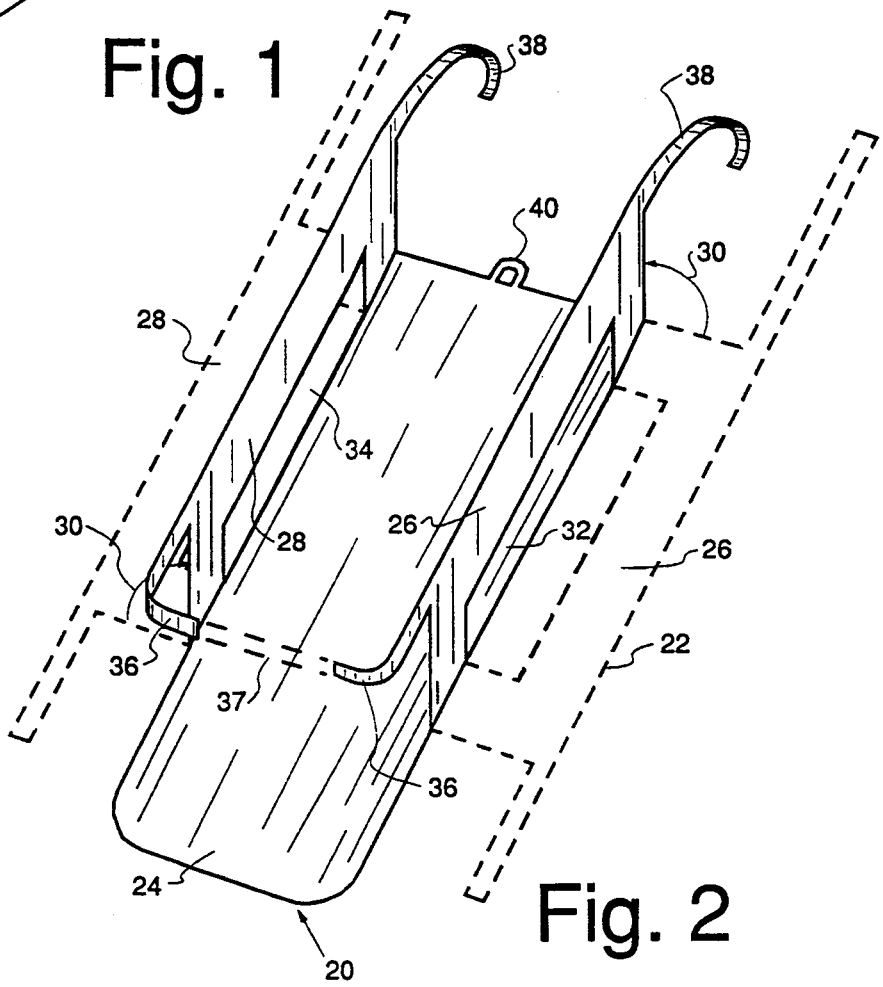
FIG. 2 is a perspective review showing a simplified embodiment schematically illustrating the concept of the present invention.

Turning now to FIG. 2, a simplified version of the present invention is depicted at 20 in a form as might be fabricated from sheet metal or sheet plastic. More specifically, the pattern indicated by the dashed lines 22 including the base 24 would be cut from a planar sheet of material. The side rails or panels 26 and 28 would then be rotated upwardly, as indicated by the arrows 30, to form side panels having openings 32 and 34 provided therein. Note that the base 24 extends forwardly of the side rails for purposes which will be mentioned below. Extending from each end of the side rails 26 and 28 are elongated tabs 36 and 38. The tabs 36 are bent inwardly toward each other, while the tabs 38 are rolled 90° so that they can be rolled or bowed downwardly to form rounded hook-shaped members. As suggested by the dashed lines 37, the tabs 36 may alternatively be made long enough to allow them to be joined at their distal ends. A hanging eyelet 40 is formed at the rear edge of base 24.

In accordance with the present invention, the base 24 is extended forwardly of sides 26 and 28 approximately the length of a typical cap visor; the width of the base 24 is made slightly less than the width of a typical visor, i.e. the dimension 16 in FIG. 1; and the height of the openings 32 and 34 are made approximately one-third the height of a typical cap, i.e. one-third of the height 18 as depicted in FIG. 1. The length of the base 24 may be of any suitable length, but is preferably on the order of 24 inches (the width being approximately 7 inches). In the preferred embodiment, the sides 26 and 28 are rotated through 90° such that the angle indicated by the arrows 30 is approximately 95°-100°.

Figure 3:
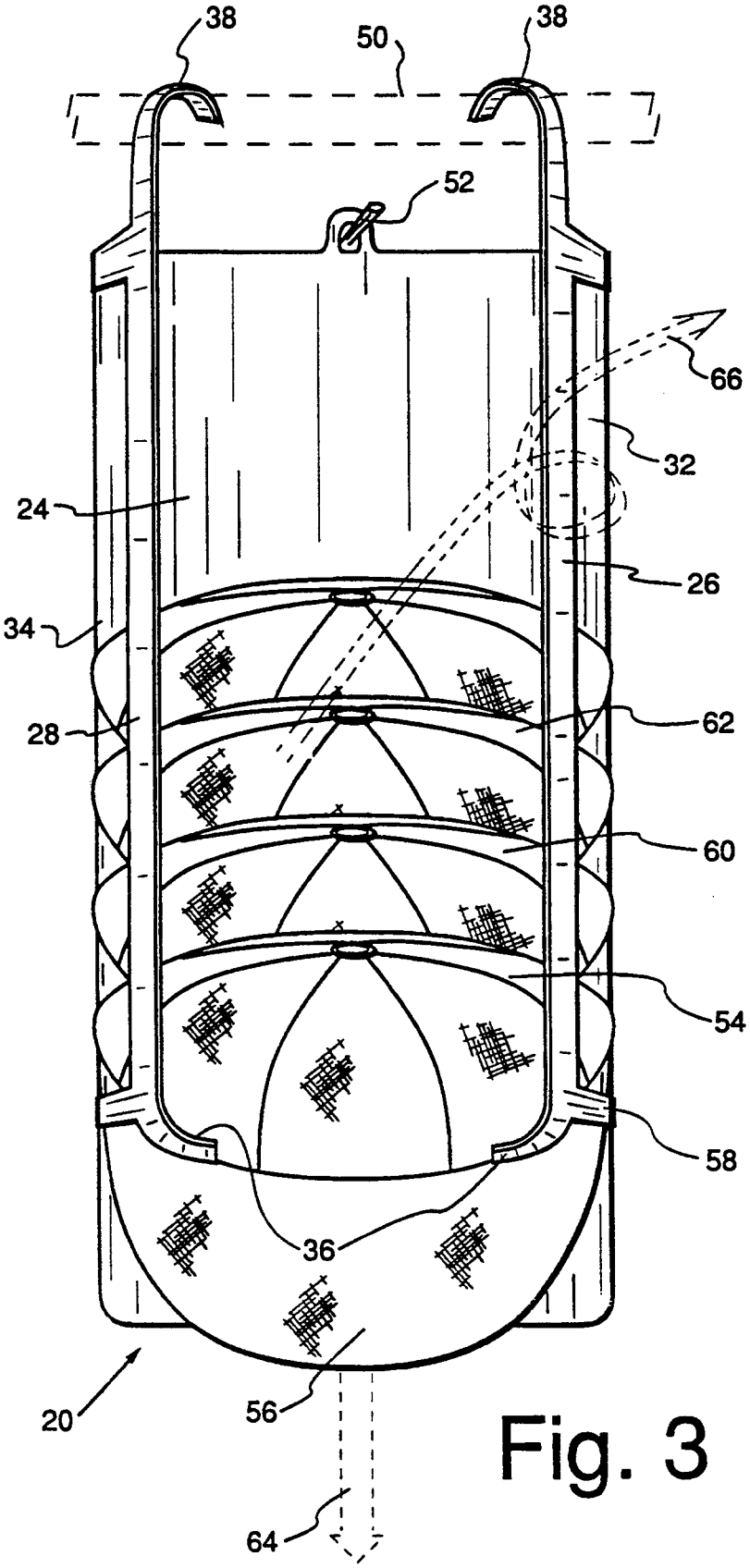
FIG. 3 is a diagram showing how a plurality of caps are supported in the embodiment of FIG. 2.

In FIG. 3, use of the present invention is illustrated wherein the rack 20 is hung from a closet pole 50 or a nail 52. A first hat 54 is then collapsed and placed between the side rails 26 and 28 with its visor 56 lying flat against the back 24, and with the visor and hat sides protruding through the openings 32 and 34. The hat is then allowed to slide downwardly until the visor engages the side portions 58 and the cap top engages the turned-in tabs or fingers 36. A second cap 60 is then similarly positioned between sides 26 and 28 and pushed downwardly so that its visor (not shown) slips beneath the visor 56 of the first cap. The third cap 62 and subsequent caps are then similarly loaded into the rack.

In the preferred embodiment, at least ten or more caps can be conveniently stored. To remove a cap or caps at the lower end of the stack one can simply pull them through and beneath the tabs of fingers 36, as suggested by the arrows 64. To remove a cap from the middle of the stack, one need merely slide those caps above it upward slightly and pull the desired cap from the stack, as suggested by the arrow 66, and then allow the remaining caps to slide downwardly into engagement with the remaining lower caps. Note that the rack may be conveniently moved by simply lifting it off the rail 50, or nail 52, and moved to a similar position or be placed in a drawer or carrier, or the like.

Figure 4:
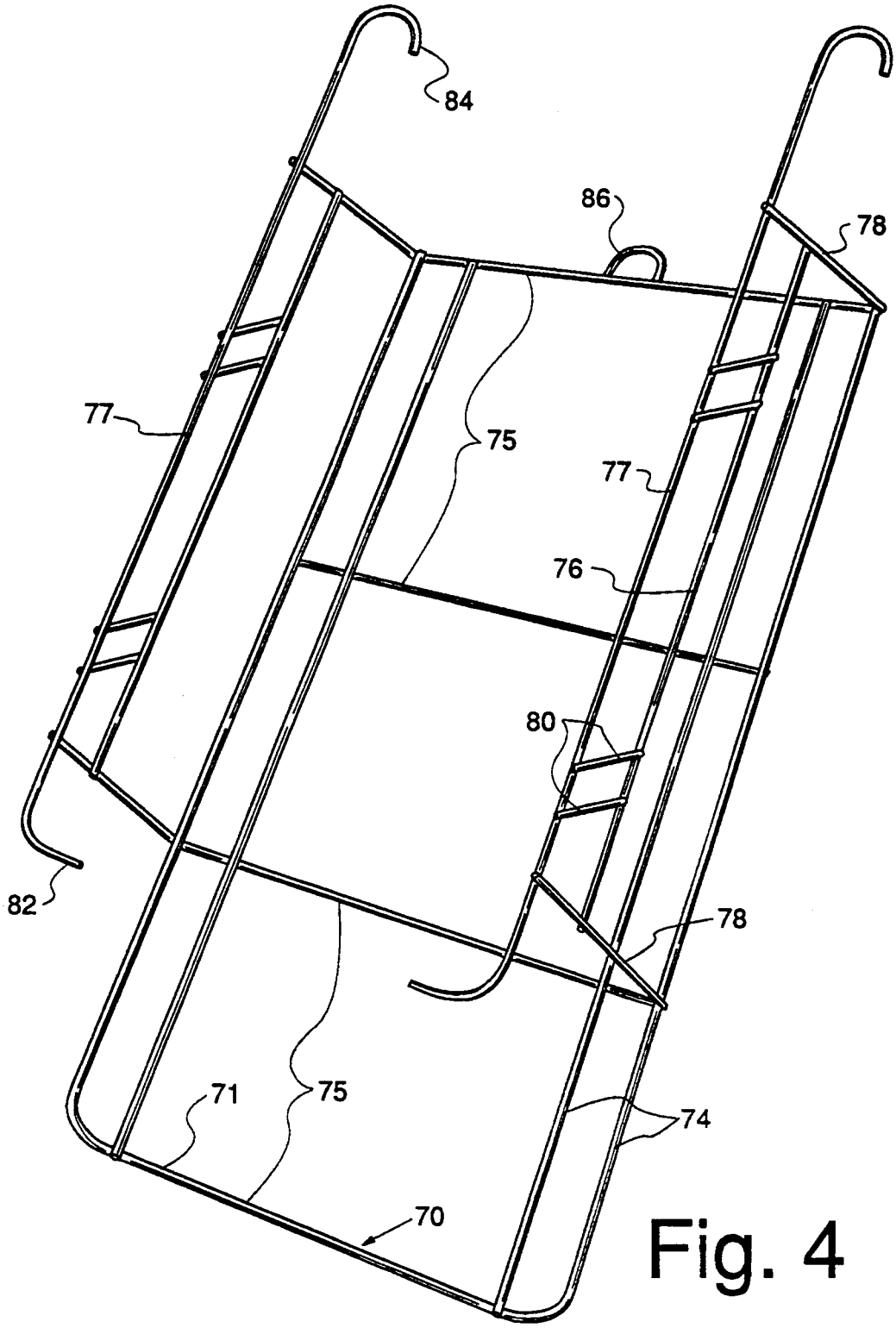
FIG. 4 is a perspective view depicting a preferred embodiment of the present invention.

Turning now to FIG. 4, a more preferred embodiment of the present invention fabricated from welded rod stock and then coated with a suitable thick paint, vinyl coating or plastic material. As in the earlier described embodiment, the rack 70 includes a generally planar base formed by the four longitudinal rods 74 and the four transverse rods 75. The side walls are formed by four longitudinally extending rods 76 and the upturned ends 78 of two of the members 75. As previously described, the side walls are slanted inwardly to engage the sides of the hats and prevent them from falling forwardly. Short decorative rods 80 serve as side stiffeners. The upper rods 77 extend beyond the side walls at both ends and are bowed inwardly at one end, as indicated at 82, to form capture fingers. The rods 77 are curved downwardly at the other end to form the pole hooks 84. A nail receiving eyelet 86 is also provided.

Note that just as the outer limits of the base are defined by a U-shaped rod 71, the uppermost side rails 77 could be made from a single U-shaped rod, in which case the capture fingers 82 would be supplanted by a capture rail as suggested in FIG. 2.

Although the present invention has been described above in terms of an embodiment fabricated from sheet metal and an embodiment fabricated from welded wire or rod stock, it will be appreciated that other embodiments made from sheet plastic or plastic rod or other suitable materials could likewise be provided. Accordingly, it is intended that the following claims be interpreted broadly to cover all alterations and modifications as fall within the true spirit and scope of the invention.

What is claimed is:

1. A rack for storing baseball caps and the like having a visor extending forwardly from a head cover, comprising:

means forming a generally planar back piece elongated in one direction and having a width in the direction transverse to said one direction slightly less than the width of a standard baseball cap, said width being the distance between two elongated side edges of said planar back piece;

means forming side rails extending along the elongated side edges of said generally planar back piece, each said rail defining an elongated opening formed therebeneath, adjacent said generally planar back piece and extending substantially the length of the rail;

cap capture means extending inwardly from one set of corresponding ends of said rails to be engaged by a cap placed in said rack with the lateral extremities of its visor extending through said openings; and means disposed at the end of said rack opposite said capture means for hanging said rack.

2. A rack as recited in claim 1 wherein said hanging means includes a hook extending from each said side rail and adapted to engage a closet pole or the like.

3. A rack as recited in claim 1 wherein said hanging means includes at least one eyelet attached to said back.

4. A rack as recited in claim 1 wherein the elongated direction of said back is longer than said rails and extends beyond said capture means.

5. A rack as recited in claim 1 wherein said back and side rails are fabricated from a sheet material, the side rails being folded out of the plane of the sheet material.

6. A rack as recited in claim 5 wherein said capture means and said hanging means are formed integral with said side rails.

7. A rack as recited in claim 1 wherein said capture means extends from one of said corresponding rail ends to the other.

8. A rack as recited in claim 1 wherein said back and said side rails are fabricated from rod stock.

9. A rack as recited in claim 1 wherein at least said rails are fabricated from rod stock.

10. A rack as recited in claim 1 wherein said hanging means includes hooks extending from a second set of corresponding ends of said rails.

* * * * *